United States Patent [19]

Nasatka

[11] Patent Number: 4,630,395

[45] Date of Patent: Dec. 23, 1986

[54] PORTABLE VEHICLE BARRICADE OR PORTABLE MAXIMUM SECURITY BARRIER

[76] Inventor: Ralph G. Nasatka, 8405 Dangerfield Pl., Clinton, Md. 20735

[21] Appl. No.: 760,091

[22] Filed: Jul. 29, 1985

[51] Int. Cl.[4] ..... E01F 13/00

[52] U.S. Cl. ..... 49/49; 49/131; 49/13; 49/25; 49/35

[58] Field of Search ..... 49/49, 131–133, 49/25, 35, 13; 404/6, 11

[56] References Cited

U.S. PATENT DOCUMENTS

| | | | |
|---|---|---|---|
| 3,626,637 | 12/1971 | Rudicel | 49/49 X |
| 3,775,912 | 12/1973 | Walls | 49/131 |
| 4,152,871 | 5/1979 | Kardash, Jr. | 49/49 |
| 4,490,068 | 12/1984 | Dickinson | 49/49 X |

*Primary Examiner*—Kenneth Downey
*Attorney, Agent, or Firm*—Shlesinger Arkwright Garvey & Fado

[57] ABSTRACT

A portable vehicle barrier for positioning in a roadway or the like has a base plate carrying first and second spaced stanchions forming a checkpoint therebetween. A shaft is pivotally secured to the base plate and extends transversely between the stanchions. A gate or barrier plate is pivotal with the shaft between a first horizontal position and a second angularly disposed position adapted for preventing vehicle passage through the checkpoint by engagement of the barrier plate with the vehicle. An anti-tampering means associated with said stanchions and said gate is provided for preventing unauthorized interference with the raising and lowering of the gate.

20 Claims, 6 Drawing Figures

110
POWER SUPPLY
97
99
ID MEANS
DETECTION MEANS
72
112
HYDRAULIC ACTUATOR
HYDRAULIC ACCUMULATOR
101
C.U.
114
EMERGENCY POWER SUPPLY
98
108
104
106
103
100
102
94
96

PORTABLE VEHICLE BARRICADE OR PORTABLE MAXIMUM SECURITY BARRIER

BACKGROUND OF THE INVENTION

Recent terrorist activity has brought to light the desirability of preventing unrestricted vehicle access to oil refineries, satellite communication stations, embassies, military bases, and other government installations. Terrorists have been known to drive explosive laden trucks and cars into government installations for the purpose of destroying buildings thereat and killing the individuals located thereabout. Frequently, these terrorists drive the explosive laden vehicle and detinate same while still seated therein. Consequently, a means for preventing the unrestricted ingress of vehicles into government installations or any building parking area is desirable in order to avoid these terrorist explosions.

Checkpoints, with movable barriers, suggested by the prior art require excavation below the surface of the ground for placement of control components, such as springs, bearings, linkage or hydraulic or electromechanical elements to move the barrier, gate or the like. Further, prior art systems often require the construction of steel reinforced concrete walls spaced apart from each other, forming a checkpoint, through which vehicle traffic is regulated. The cost of erecting such barricades is often excessive especially, when it is not clear that such an elaborate design is necessary. When a strong design is desired, it often takes to long for such a checkpoint to be constructed. Further, obstruction of main roadways, caused by checkpoint construction, unduly interferes with the daily business at the site to be protected.

U.S. Pat. No. 4,152,871, issued to Kardash, discloses a vehicle barricade having a movable barrier plate pivotally disposed on a shaft transversely extending between twospaced concrete pillars. Means are provided for pivoting the barrier plate between a horizontal position and an angularly disposed blocking position. The vehicle barricade of Kardash has two major drawbacks. First, the cost of construction and time needed for construction are both extremely high. Second, Kardash teaches a device for pivoting the barrier plate—a barrier plate hydraulic actuator—which is situated so as to be vulnerable to undesirable tampering therewith.

The disclosed invention provides a novel and unique vehicle barricade which is portable and which includes means for protecting the means for pivoting the barrier plate from any tampering or sabotage. A hinged gate or barrier plate is secured via a pivotal shaft to a base plate which may be secured to the roadway. The gate is positioned between two steel stanchions, the stanchions acting to partially house the hydraulic actuator which raises and lowers the gate and also act to form a checkpoint through which vehicles must pass. An anti-tampering shroud means cooperates with the stanchions and the gate to prevent any unauthorized interference with the hydraulic actuator. Consequently, one skilled in the art will appreciate that the disclosed vehicle barricade is a significant advance in the art.

OBJECTS AND SUMMARY OF THE INVENTION

The primary object of the disclosed invention is to provide a portable vehicle barrier having a gate secured to the base of the vehicle barrier and an anti-tampering means associated with the vehicle barrier for preventing unauthorized interference with the raising and lowering of the gate.

Another object of the disclosed invention is to provide a portable vehicle barrier for positioning in a roadway or the like which requires no excavation of the roadway and which may be installed in a short amount of time with minimal effort.

Still another object of the disclosed invention is to provide a portable vehicle barrier in the form of a unit, the unit comprising: first and second spaced stanchions, plate means extending between the stanchions; hinged gate means, including a gate, attached to the plate means; means to raise and lower the gate; and control means associated with the unit for controlling the operations thereof.

Another object of the disclosed invention is to provide an automatically operable barrier or checkpoint including an ID means for identifying an official vehicle and a second means associated with the ID means for detecting an unauthorized vehicle and for automatically producing a signal to move a gate into a position to block the vehicles progress.

Still another object of the disclosed invention is to provide a portable vehicle barrier having means for controlling the barrier including: an emergency switch for raising a barrier gate in a short amount of time; and, a timer switch for positioning the gate dependent on the time of day.

These and other objects and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 3:
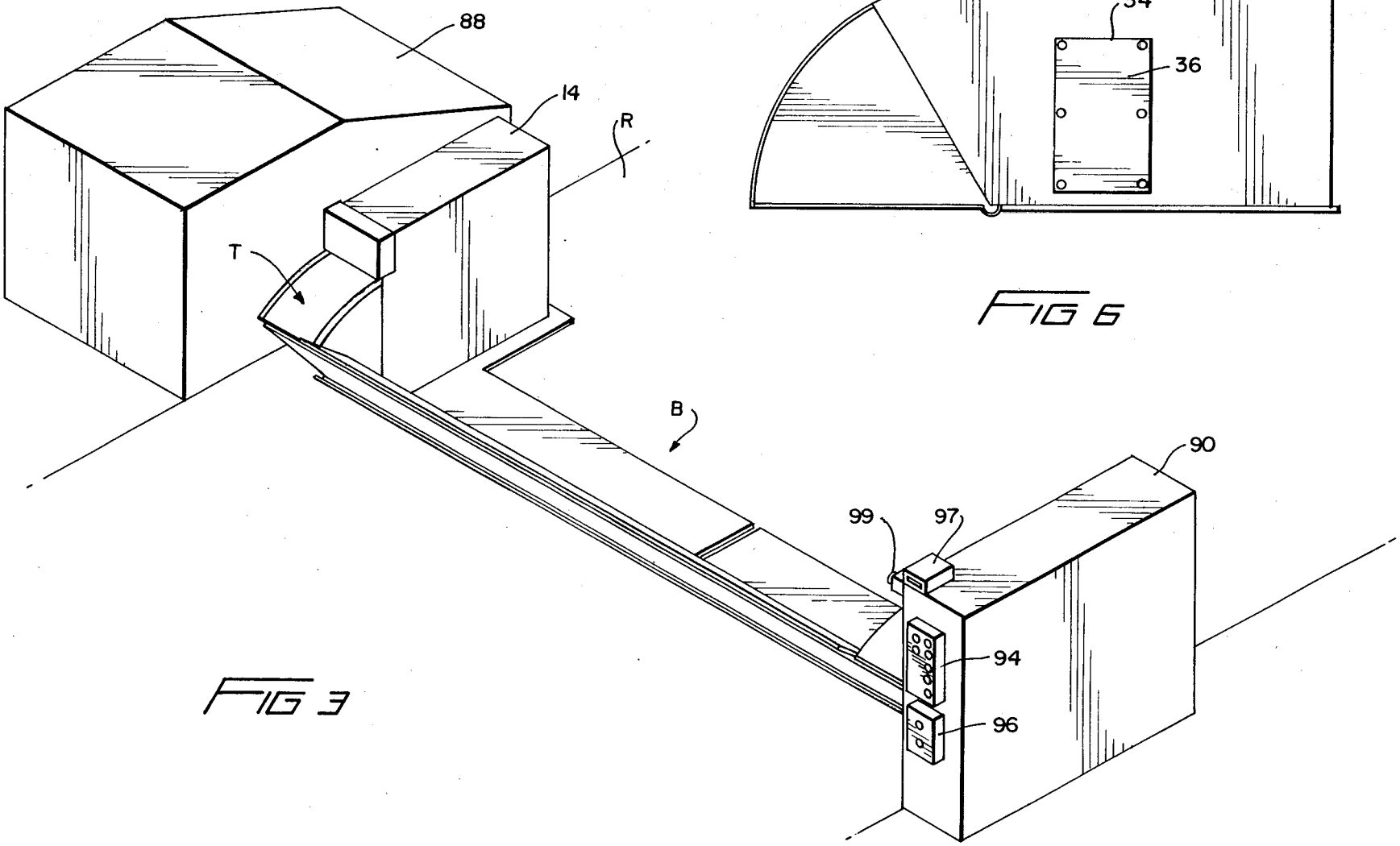
FIG. 3 is a top side perspective view of the vehicle barrier of the invention.
Figure 4:
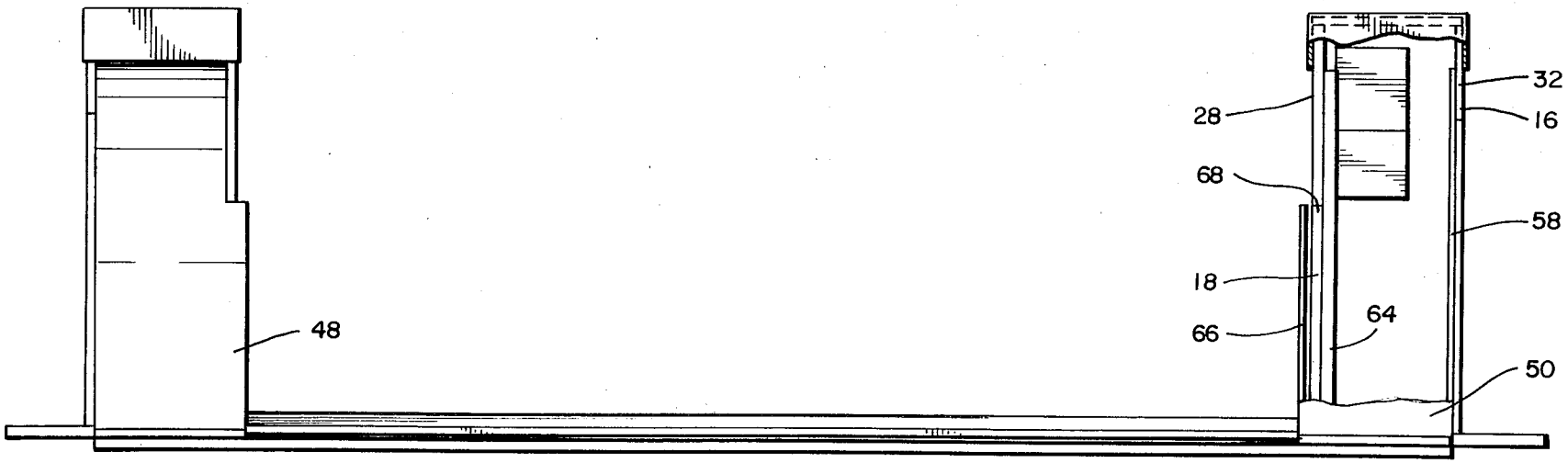
FIG. 4 is a front elevational view with the cutout portion showing the inner structure of an anti-tampering shroud.
Figure 5:
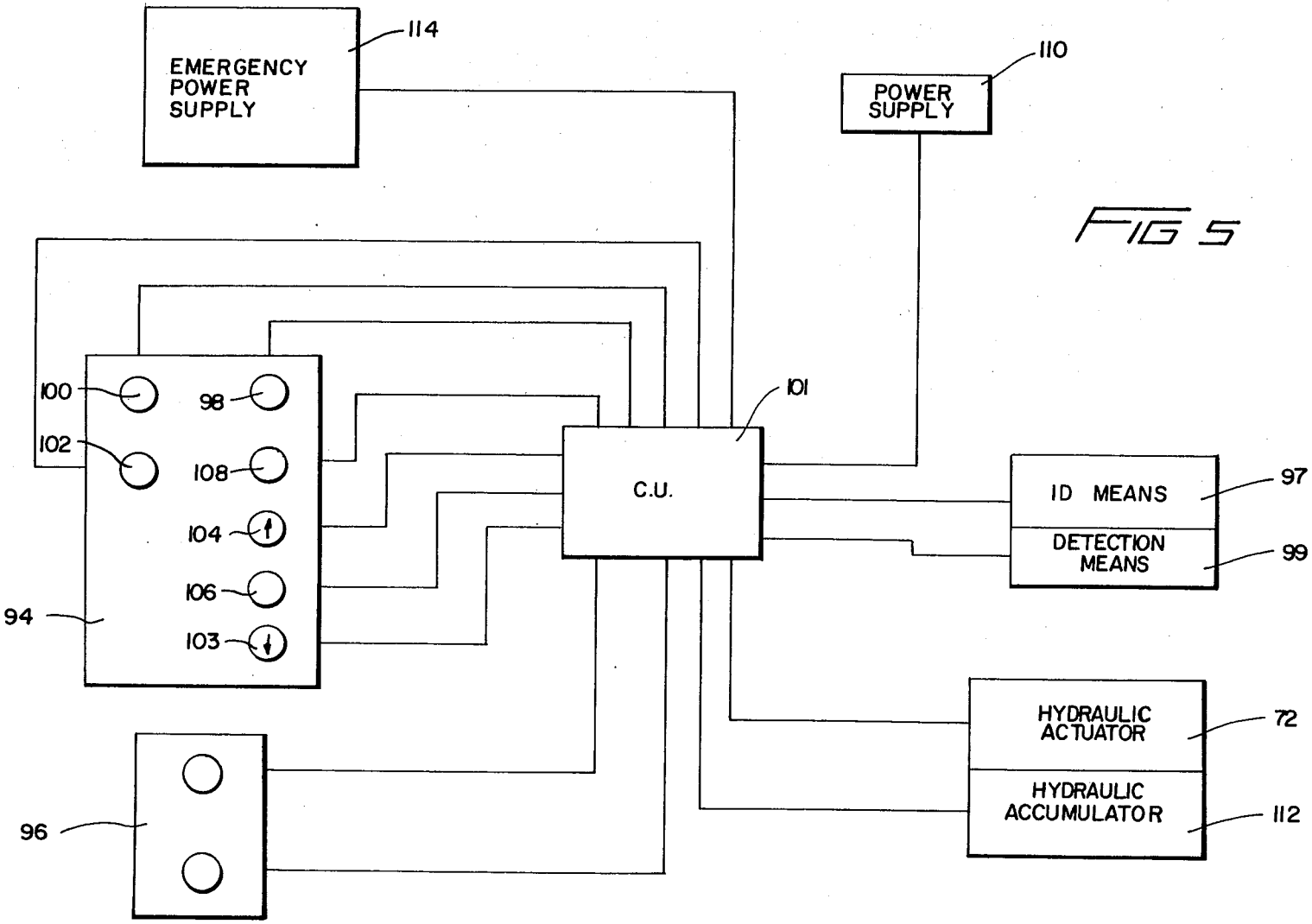
FIG. 5 is a schematic of means for controlling the vehicle barrier of the invention.

A portable vehicle barrier or checkpoint B, as best shown in FIG. 3, is disposed for interdicting a roadway R. While a roadway R is disclosed, the portable barrier B is intended for blocking or interdicting the approach ramp to an underground garage, a vehicle entrance to a building, a vehicle entrance to a parking lot and the like. Consequently, the portable barrier B is capable of being moved to any location where the necessity of stopping and preventing the further movement of a vehicle, particularly a vehicle loaded with explosives, is desired.

A first steel stanchion 10 is contiguously disposed generally along one side of a base plate 12. Another similar second stanchion 14 is disposed along the other side of base plate 12 and extends longitudinally approximately the same length as does first stanchion 10.

Stanchions 10 and 14 are each essentially mirror images of the other. Consequentially, only the stanchion 10 will be thoroughly described but one skilled in the art will appreciate that the stanchion 14 will be similarly constructed.

Stanchion 10 is formed of an access plate or outside plate 16, a strike plate or inside plate 18, a top plate 20 welded to the top portion of outside plate 16 and the top portion of inside plate 18, an end plate 22 having four sides three of which are welded to a respective edge of the outside plate 16, inside plate 18 and top plate 20. Bottom edges of plates 22, 18 and 16 are welded at weld seam 24 to base plate 12. At the end opposite of that at which the end plate 22 is situated, cap plate 26 is positioned. Cap plate 26 extends from top plate 20 down towards the base plate, a fraction of the height of stanchion 10. Cap plate 26 may be bolted or similarly fastened to top plate 20, outside plate 16 and inside plate 18.

Inside plate or strike plate 18 includes an angularly disposed portion 28. Angular portion 28 is adapted for engaging and supporting a portion of a gate 30. Because strike plate 18 is used to support gate 30 it is preferably made of one inch thick steel. Outside plate 16 has an angular portion 32. Outside plate 16, is not used to support gate 30 and therefore, outside plate 16 is preferably made of three eights inch thick steel. As best seen in outside plate 16 may have an access opening 34 covered by access plate 36 which is bolted to outside plate 16.

Figure 1:
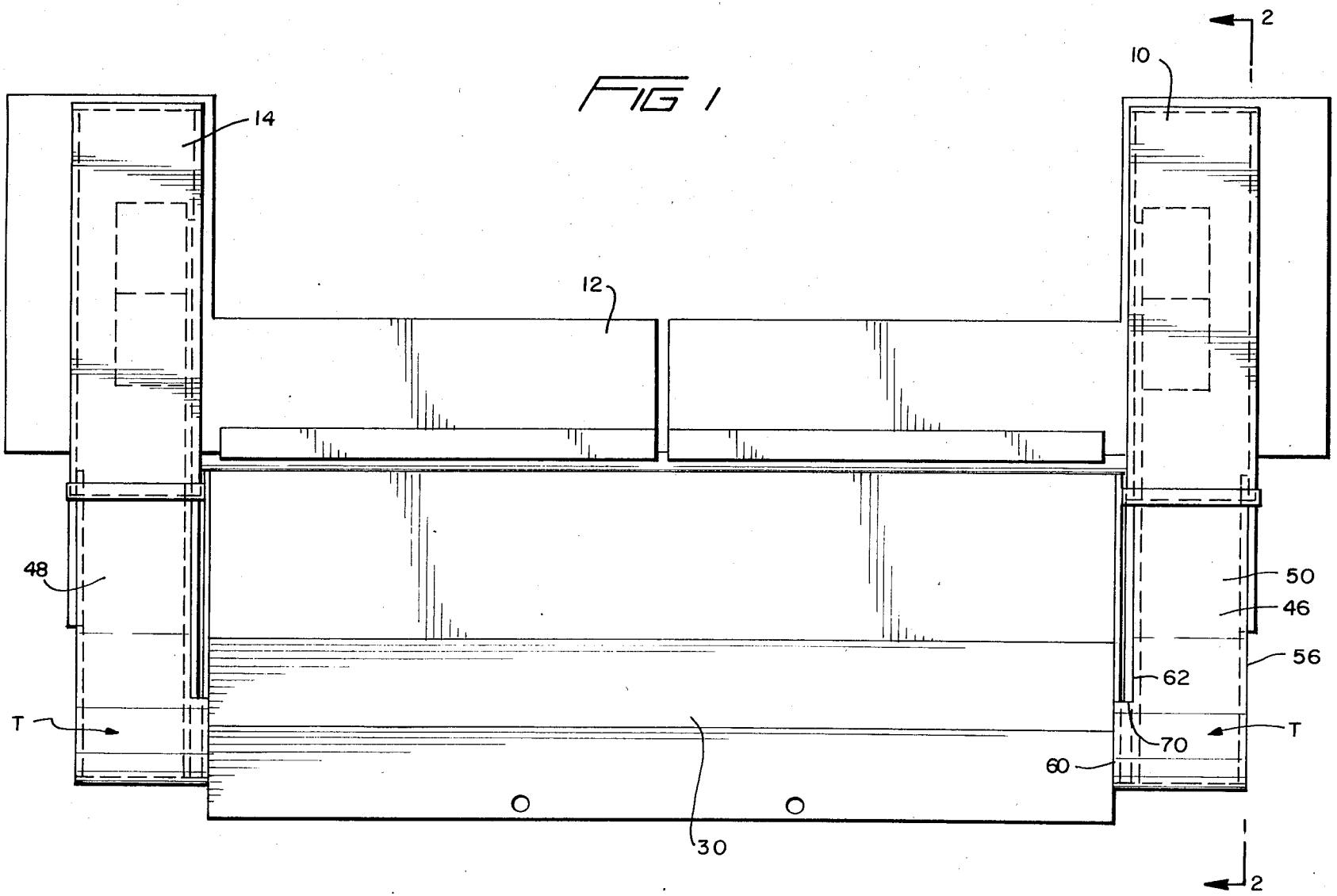
FIG. 1 is a top plan view of the vehicle barrier of the invention.
Figure 2:
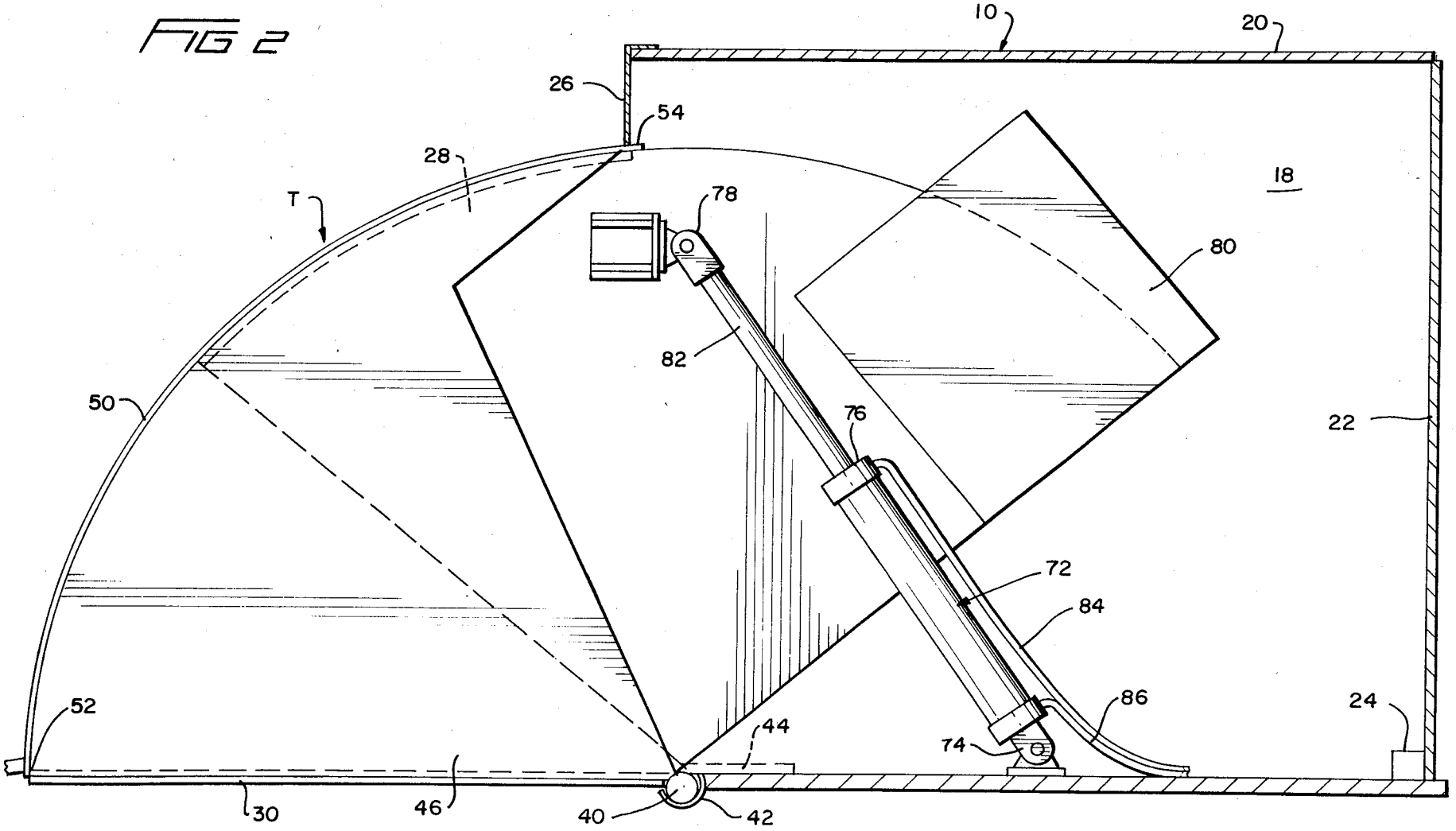
FIG. 2 is a section view taken along the line 2—2 of FIG. 1.
Figure 6:
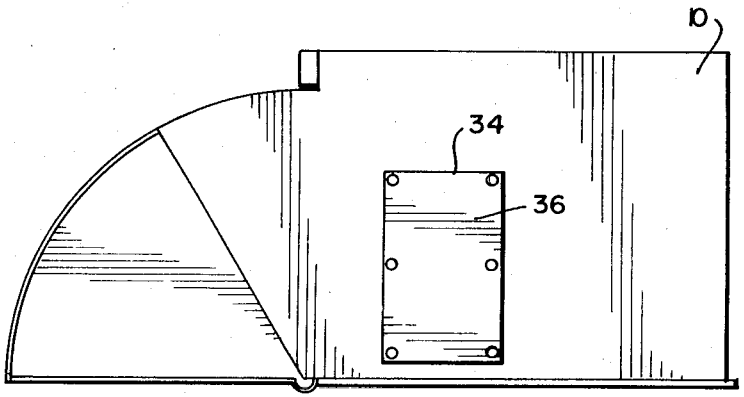
FIG. 6 is a side view of the vehicle barrier of the invention.

The barrier plate or gate 30 is secured by welding or the like to pivotal shaft 40. As is best shown in FIG. 2, a generally semicircular cylindrical recess 42 for receiving shaft 40 is fixed to the frontend of base plate 12 by welding or the like. The recess 42 spans substantially the distance between stanchions 10 and 12.

Base plate 12, may be secured to the roadway by means of a plurality of expansion bolts. In the vacinity of cylindrical recess 42 a gate retainer 44 is positioned to keep shaft 40 seated in cylindrical recess 42. Gate retainer 44 may be secured under the expansion bolts employed to keep base plate 12 fixed to the roadway.

An anti-tampering means generally designated T, cooperates with each of the stanchions 10 and 14 and the gate 30 to prevent unauthorized interference with the raising and lowering of the gate 30. The anti-tampering means T is made up of a first arcuate box segment 54, associated with the first stanchion 10 and a second arcuate box segment 48 associated with the second stanchion 14.

The arcuate box segments 46 and 48 are each essentially mirror images of the other. Consequentially, only first arcuate box segment 46 will be thoroughly described but one skilled in the art will appreciate that the second arcuate box segment 48 will be similarly constructed.

First arcuate box segment 54 has an arcuate plate 50 with a first end 52 welded to the gate 30 and a second end 54 which is received into the stanchion 10 just under top plate 26. Arcuate plate 50 has a first edge 56 which is welded to outside plate 58. Outside plate 58 is disposed contiguous with outside plate 16 of stanchion 10. Outside plate 58 is free to slide parallel to outside plate 16, thereby, allowing a portion of outside plate 58 to be received within stanchion 10. Arcuate plate 50 has a second edge 60 with a cutout portion 62. A gate strike plate 64 is welded at the edge of the cutout portion 62 and a gate inside plate 66 is welded along the second edge 60 of arcuate plate 50. Each of outside plate 58, gate strike plate 64 and inside plate 66 have one end welded to gate 30. When gate 30 is allowed to pivot about shaft 40 outside plate 58 slides within stanchion 10 as described above and gate strike plate 64 also is received by stanchion 10. Inside plate 66 is positioned contiguous with inside plate 18. When gate 30 pivots upwardly, inside plate 66 slides along the outside of inside plate 18 while the edge of cutout portion 62 slides along the inside of inside plate 18. The gate is free to pivot upwardly until the angular portion 28 of housing strike plate or inside plate 18 strikes gate 30; gate strike plate 64 strikes base plate 12; and, upper portion 68 of inside plate 18 abuts end 70 of cutout portion 62.

Hydraulic actuator or means for raising and lowering the gate 72 is secured to base plate 12 by means of brackets 74. This hydraulic actuator 72 may be in the form of a cylinder and piston assembly 76 pivotally connected to bracket 74 and also pivotally connected to bracket 78 which is secured to gate strike plate 64. The cylinder and piston assembly may be positioned within either stanchion 10 or stanchion 14. A counterweight 80 may be secured to gate strike plate 64 and act to independently maintain gate 30 in a horizontal position without the need for any other force. Similarly, the counterweight 80 may facilitate the pivoting of the gate 30 from the horizontal position to the angularly disposed position.

As can be seen in FIG. 2, the piston 82 of cylinder and piston assembly 76 is, preferably, in an extended position when the gate 30 is in a horizontal position. Similarly, retraction of piston 82 by utilization of hydraulic lines 84 and 86 will cause the gate to pivot to the angularly disposed position wherein an angle of approximately 40° to the horizontal is established.

The motors and pumps for operating the cylinder and piston assembly 76 are contained in a steel housing 88 disposed adjacent stanchion 10 and are of a type well known in the art.

A control housing 90 is positioned adjacent stanchion 10 and houses a control unit 92. A control instrumentation panel 94 is mounted on control housing 90 along with vehicle signal means 96.

An ID means 97 for identifying an official vehicle and for producing a signal to lower the gate may be provided. ID means 97 may be any known device such as a card reader, digital keypad, laser vehicle identification system, radio control system, timers with magnetic vehicle detectors, or the like. Associated with the ID means, there is a detection means 99 for detecting an unauthorized vehicle and for automatically producing a signal to raise the gate precluding the vehicle's passage through the checkpoint. Detection means 99 may be any photo sensitive detector or the like which sends out a signal when an object passes before it.

On instrumentation control panel 94 there is located several switches or the like for allowing an operator to control the position of the gate 30 through control unit 101. An emergency switch 98 is provided for allowing the gate to be raised in approximately 1 second. A reset switch or the like 100 is provided to cancel the effects of pressing the emergency switch 98. A timer switch 102 is provided to regulate the position of the gate 30 dependent on time of day. A gate down switch or the like 102 may be provided to lower the gate. A gate up switch or the like 104 may be provided to raise the gate 30. A stopswitch or the like 106 is provided to hold the movement of the gate in any position. The on/off switch or the like 108 is provided to switch the power source 110 on thereby powering the control panel 94 and hydraulic actuator 72.

In the event of a power failure, a hydraulic accumulator 112 is provided to power the hydraulic actuator 72. A battery backup or emergency power supply 114 is also provided to power the control unit 92 during power failure periods. The hydraulic accumulator 112 may be housed in housing 88 adjacent stanchion 14. Battery backup or emergency power supply 114 may be housed within control housing 90 adjacent stanchion 10.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A portable vehicle barrier for positioning in a roadway or the like comprising:

(a) first and second spaced stanchions;

(b) plate means extending between said spaced stanchions;

(c) means for securing said barrier to the roadway;

(d) hinged gate means;

(e) said gate means being attached to said plate means;

(f) means in at least one of said stanchions for raising and lowering said gate means between a first generally horizontal position and a second angularly disposed position; and, (g) anti-tampering means associated with said stanchions and said gate means, said anti-tampering means being fixed to said gate means and movable relative to said stanchions, for preventing unauthorized interference with the raising and lowering of the gate means.

2. A portable vehicle barrier as in claim 1, wherein:

(a) said anti-tampering means comprises first and second shroud means movable with said gate means for simultaneously cooperating with respective said stanchions to enclose said means for raising and lowering said gate means.

3. A portable vehicle barrier as in claim 2, wherein:

(a) each said shroud means comprises an arcuate box segment articulated to said plate means and having a first box edge and a second box edge, said second box edge being contiguous with said gate means; and, (b) slot means formed in each of said stanchions for receiving a portion of said box segment.

4. A portable vehicle barrier as in claim 3, wherein:

(a) each said arcuate box segment comprises an arcuate plate having a first arcuate plate edge and a second arcuate plate edge and a cutout edge portion adjacent said first plate edge;

(b) a first box plate having one side contiguously disposed along said first arcuate plate edge and spaced from said cutout edge portion; and, (c) a second box plate having one side contiguously disposed along said second arcuate plate edge.

5. A portable vehicle barrier as in claim 1 wherein:

(a) each of said stanchions includes an angulary disposed portion adapted for engaging and supporting a portion of said gate means when in said second position.

6. A portable vehicle barrier as in claim 1 wherein:

(a) said means for raising and lowering said gate means includes cylinder and piston means; and, (b) said cylinder and piston means are pivotally connected to said gate means and are adapted for raising and lowering said gate means.

7. A portable vehicle barrier as in claim 6 wherein:

(a) said gate means has an arcuate box segment means extending therefrom adjacent to and partially received by said stanchions;

(b) said box segment means is counterweighted; and, (c) said cylinder and piston means are connected to said arcuate box segment.

8. A portable vehicle barrier as in claim 1, wherein:

(a) said hinged gate means further comprises shaft receiving means secured in said plate means and extending generally transversely between said stanchions; and, (b) shaft means cooperatively associated with said shaft receiving means, adapted for pivoting on an axis, and secured to said gate means.

9. A portable vehicle barrier as in claim 8 wherein:

(a) said shaft receiving receiving means includes means cooperating with said shaft means for preventing removal of said shaft means therefrom.

10. A portable vehilce barrier as in claim 9 wherein:

(a) said means cooperating with said shaft means for preventing removal includes at least one gate means retainer member extending angularly from said shaft receiving means and fixed to said plate means.

11. A prefabricated vehicle barricade and checkpoint for roadways or the like, comprising:

(a) base plate means securable to said roadway;

(b) first and second spaced stanchions contiguously disposed on opposite sides of said base plate means;

(c) shaft receiving means fixed to said plate means and extending generally transversely between said stanchions;

(d) shaft means cooperatively associated with said shaft receiving means and adapted for pivoting on an axis;

(e) gate means secured to said shaft means and pivotal therewith between a first generally horizontal position and a second angularly disposed position, said first position adapted for permitting vehicle passage through said checkpoint and said second position adapted for preventing vehicle passage through said checkpoint by engagement of said gate means with a vehicle;

(f) means associated with said gate means for pivoting said gate means between said first and second positions; and, (g) anti-tampering means associated with said stanchions and said gate means, said anti-tampering means being fixed to said gate means and movable relative to said stanchions, for preventing unauthorized interference with said means for pivoting said gate.

12. A prefabricated vehicle barricade as in claim 11 wherein:

(a) each of said stanchions includes an angularly disposed portion adapted for engaging and supporting the portion of said barrier plate means when in said second position.

13. A prefabricated vehicle barricade as in claim 11, wherein:

(a) said anti-tampering means comprises first and second shroud means movable with said gate for simultaneously cooperating with respective said stanchions to enclose said means for raising and lowering said gate.

14. An electrically operated, manual and automatic, portable vehicle barrier or checkpoint for positioning in a roadway or the like, comprising:

(a) first and second spaced stanchions;

(b) plate means extending between said spaced stanchions;

(c) hinged gate means, attached to said plate means;

(d) means in at least one of said stanchions for raising and lowering said gate means between a first generally horizontal position and a second angularly disposed position;

(e) manually and automatically operated electrical control means including switch means or the like, said control means controlling the position of the gate dependent on when said switch means or the like is operated;

(f) vehicle control signal means; and (g) anti-tampering means associated with said stanchions and said gate means, said anti-tampering means being fixed to said gate means and movable relative to said stanchions, for preventing unauthorized interference with said means for pivoting said gate.

15. A portable vehicle barrier as in claim 14, wherein:

(a) said control means comprises an emergency switch producing a signal for positioning said gate means in said second position; and, (b) a timer switch for positioning said gate means.

16. A portable vehicle barrier as in claim 15, wherein:

(a) said control means further comprises a reset switch for cancelling the effects of said emergency switch;

(b) a gate up switch for moving said gate to said second position;

(c) a gate down switch for moving said gate to said first position;

(d) stop switch for stopping the gate in any position desired; and, (e) an on/off switch for powering the control means.

17. A portable vehicle barrier as in claim 14, wherein:

(a) said vehicle control signal comprises a first lighted signal activated when said gate is in said first position; and, (b) a second lighted signal activated when said gate is in a position other than said first position.

18. A portable vehicle barrier as in claim 14, wherein:

(a) ID means for identifying an official vehicle and for producing a signal to move said gate from said second position to said first position; and, (b) second means associated with said ID means for detecting an unauthorized vehicle and for producing a signal to automatically move said gate from said second position to said first position.

19. A portable vehicle barrier as in claim 18, wherein:

(a) said second means includes a photo sensitive detector for detecting an unauthorized vehicle prior to said vehicle reaching the checkpoint.

20. A portable vehicle barrier as in claim 14 further comprising:

(a) an emergency power supply; and, (b) a hydraulic accumulator whereby when conventional power is terminated, said emergency power supply powers said control means and said hydraulic accumulator powers said means for raising and lowering said gate means.

* * * * *